US005741154A

United States Patent [19]

Fujikura et al.

[11] Patent Number: 5,741,154

[45] Date of Patent: Apr. 21, 1998

[54] ELECTRICAL CONNECTOR FOR FLAT CABLE

[75] Inventors: Mitsuo Fujikura, Sagamihara; Shinsuke Kunishi, Hadano; Minoru Fukushima, Yokohama, all of Japan

[73] Assignee: Molex Incorporated, Lisle, Ill.

[21] Appl. No.: 710,889

[22] Filed: Sep. 24, 1996

[30] Foreign Application Priority Data

Nov. 24, 1995 [JP] Japan ..... 7-013435 U

[51] Int. Cl.[6] ..... H01R 9/07

[52] U.S. Cl. ..... 439/495

[58] Field of Search ..... 439/495, 492, 439/493, 259, 260, 67, 77, 630, 329, 341

[56] References Cited

U.S. PATENT DOCUMENTS 4,477,137 10/1984 Ayer ..... 339/59
4,640,562 2/1987 Shoemaker ..... 339/17
4,647,131 3/1987 Wan Woensel ..... 339/74
4,778,403 10/1988 Ikesugi et al. ..... 439/329
4,936,792 6/1990 Onoue et al. ..... 439/329
4,944,690 7/1990 Imai ..... 439/492
5,458,506 10/1995 Yamaguchi et al. ..... 439/495

*Primary Examiner*—Neil Abrams
*Assistant Examiner*—Yong Ki Kim
*Attorney, Agent, or Firm*—Stephen Z. Weiss

[57] ABSTRACT

An electrical connector is disclosed for connecting a flat cable. The connector includes a dielectric housing mounting a plurality of conductive terminals. The housing has a front end adapted for receiving the flat cable in engagement with the terminals, a rear end and opposite sides. An actuator is pivotally mounted on the housing for pivotal movement between a first position allowing insertion of the flat cable into engagement with the terminals and a second position biasing the cable against the terminals. An independent engagement part is mounted on the housing and includes a pivot about which the actuator is pivotable between said positions.

9 Claims, 8 Drawing Sheets

ELECTRICAL CONNECTOR FOR FLAT CABLE

FIELD OF THE INVENTION

This invention generally relates to the art of electrical connectors and, particularly, to electrical connectors for terminating flat cables, such as flat flexible cables, printed circuit boards or the like without requiring any insertion force.

BACKGROUND OF THE INVENTION

There are a wide variety of zero insertion force electrical connectors particularly adapted for terminating flat cables, such as flexible flat cables. These electrical connectors conventionally use actuators to push the flexible flat cables, flexible printed circuit boards or the like against resilient contacts or terminals which are mounted in the connector housings.

Heretofore, the actuators have been designed to be pushed in and pulled out of the connector housings. Such designs require the application of insertion forces to the flat cables. In addition, such designs have inevitably resulted in an increase in the overall size of the connectors.

Consequently, zero insertion force electrical connectors for flat cables have been designed with actuators which are pivotable between first, open positions allowing free insertion of the cables into the connector housings, and second, closed positions for clamping the flat cables against the terminals. In a typical connector having a pivotally mounted actuator, the connector housing has a front end adapted for receiving the flat cable in engagement with the terminals, a rear end and opposite sides. Pivot means are provided on the opposite sides. The pivotal actuator includes opposite side pivot arms engaging the outsides of the opposite sides of the housing, and the actuator pivots between its positions about the pivot means of the housing.

Problems have been encountered with such zero insertion force electrical connectors having pivotally mounted actuators. One problem revolves around the fact that the pivot arms of the actuator must be spread apart to mount the actuator on the housing, with the pivot arms outside the opposite sides of the housing and in engagement with the pivot means of the housing. The pivot arms of the actuator often can become broken during mounting and, if the actuator is fabricated of metal material, the arms become deformed when they are spread apart for mounting the actuator on the housing.

Another problem involves the wear on the pivot means of the housing when the actuator is pivoted thereabout. Specifically, the housing must be fabricated of dielectric material, such as plastic or the like, to mount the conductive terminals. The pivot means of the plastic housing are easily worn or damaged due to the pivoting action of the actuator, particularly if the actuator is fabricated of metal material.

The present invention is directed to solving various problems in zero insertion force electrical connectors, particularly of the pivoting actuator type, and specifically directed to the problems of deforming the actuator during assembly and damage to the housing pivots during use.

SUMMARY OF THE INVENTION

An object, therefore, of the invention is to provide a new and improved electrical connector for a flat cable, of the character described.

In the exemplary embodiment of the invention, the connector includes a dielectric housing mounting a plurality of conductive terminals. The housing has a front end adapted for receiving the flat cable in engagement with the terminals, a rear end and opposite sides. An actuator is pivotally mounted on the housing for pivotal movement between a first position allowing insertion of the flat cable into engagement with the terminals and a second position biasing the cable against the terminals. An independent engagement part is mounted on the housing and includes pivot means about which the actuator is pivotable between said positions.

As disclosed herein, both the engagement part and the actuator are fabricated of metal material. The housing is adapted for mounting on a printed circuit board. The engagement part includes a solder tail for soldering to an appropriate pad on the printed circuit board. The actuator includes a pair of side pivot arms positionable outside the opposite sides of the housing without significantly spreading the pivot arms. Complementary interengaging mounting means are provided between the housing and the engagement part for mounting the engagement part at the rear of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 4:
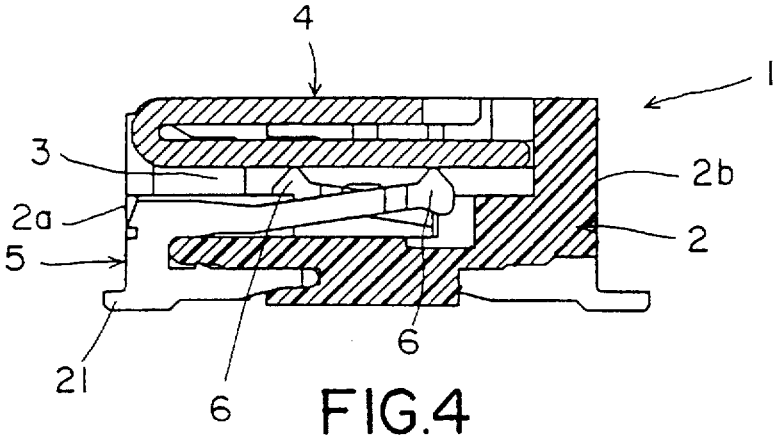
FIG. 4 is a vertical section taken generally along line A—A in FIG. 3.
Figure 5:
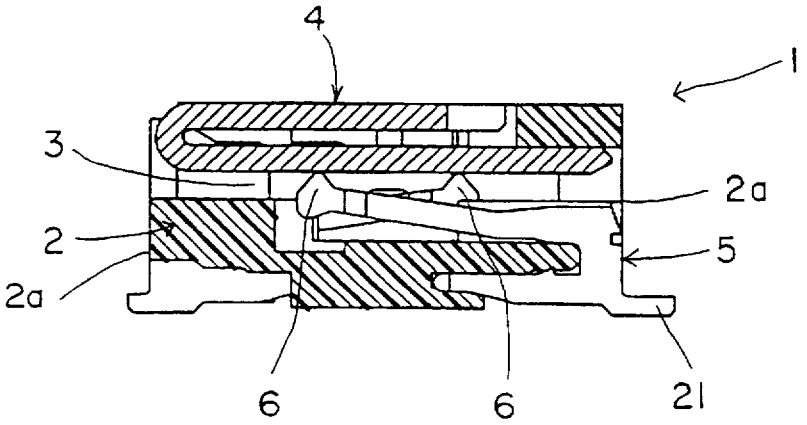
FIG. 5 is a vertical section taken generally along line B—B in FIG. 3.

Referring to the drawings in greater detail, and first to FIGS. 1–5, the invention is embodied in a flat cable connector, generally designated 1, which includes a dielectric housing, generally designated 2, such as of molded plastic material or the like. The housing has an opening 3 for inserting a flat cable, such as a flat flexible cable, printed circuit board or the like. A rotatable or pivotal actuator, generally designated 4, covers opening 3 of housing 2. A plurality of terminals, generally designated 5, are mounted on housing 2 in a parallel arrangement. Specifically, the terminals are press-fit in housing 2 alternately from the front 2*a* and rear 2*b* thereof as shown in FIGS. 4 and 5, so that flexible contacts 6 of the terminals project into opening 3 of the housing to oppose the undersurface of actuator 4.

Figure 6:
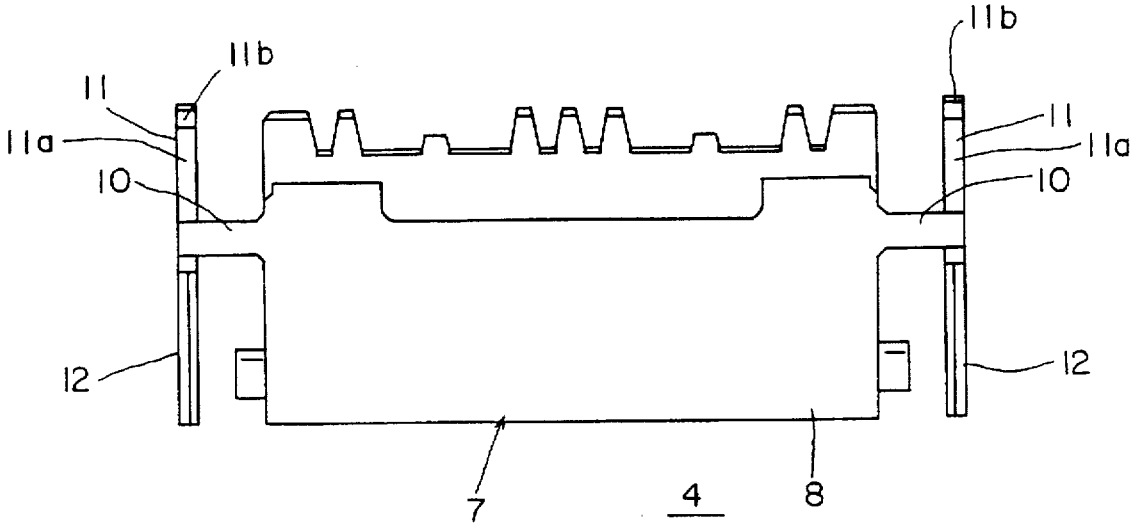
FIG. 6 is a top plan view of the actuator of the connector.
Figure 7:
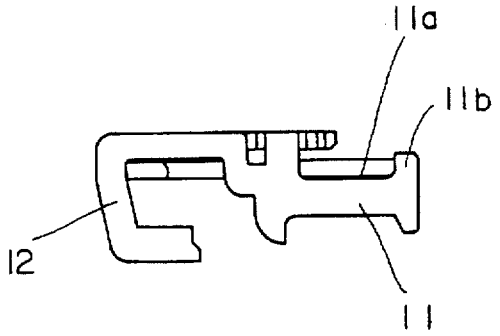
FIG. 7 is a side elevational view of the actuator.
Figure 8:
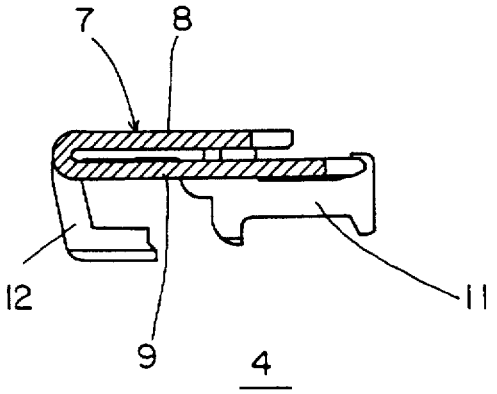
FIG. 8 is a vertical, central section through the actuator.

Actuator 4 is stamped and formed of sheet metal material coated with an insulating resin. Referring to FIGS. 6–8 in conjunction with FIGS. 1–5, the actuator is a bi-folded plate, generally designated 7, defining a U-shape in cross-section. The plate is large enough to cover opening 3 of housing 2. The bi-folded plate defines an upper plate section 8 and a lower plate section 9. The upper plate section has lateral or outwardly extending protrusions 10 at opposite sides thereof (see FIG. 6) which join a pair of side pivot arms 11 integrally connected to protrusions 10. The pivot arms extend rearwardly of protrusions 10 along opposite sides 2*c* of housing 2. The pivot arms have front extensions 12 integrally connected to protrusions 10 and extending forwardly therefrom along opposite sides 2*c* of the housing. Pivot arms 11 of actuator 4 are provided for pivoting the actuator about pivots 14 (described hereinafter) to open or close opening 3 of the housing, whereas front extensions 12 of the pivot arms of the actuator are provided for locking the actuator in its closed position, as described below.

Each pivot arm 11 is generally T-shaped and includes a longitudinal edge 11*a* terminating in a rear hook 11*b* outside each side 2*c* of housing 2, so that the edge engages its respective pivot 14 at the respective side 2*c* of the housing. Front extensions 12 of the pivot arms are generally L-shaped for engagement beneath similarly L-shaped projections 15 protruding from the sides 2*c* of housing 2.

Figure 9:
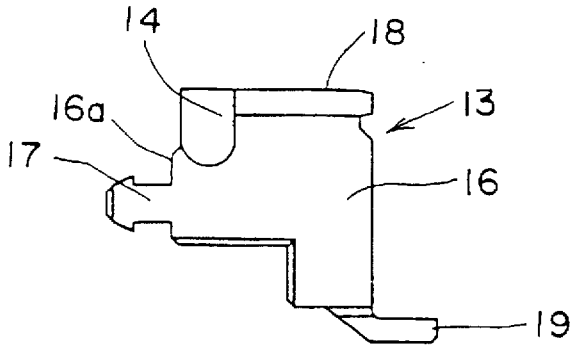
FIG. 9 is a side elevational view of the engagement part of the connector.
Figure 10:
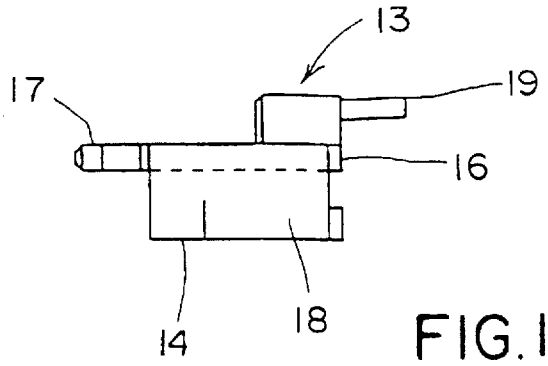
FIG. 10 is a plan view of the engagement part.
Figure 11:
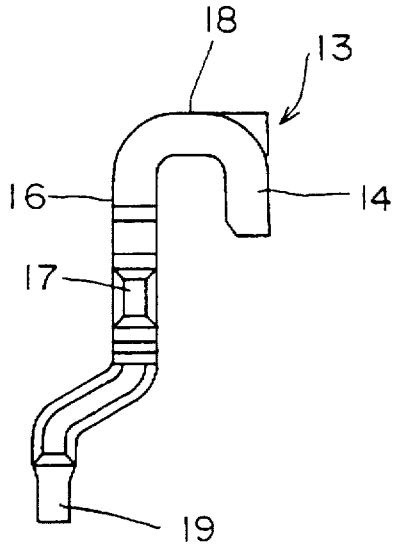
FIG. 11 is an enlarged front view of the engagement part.

Electrical connector 1 includes one or more independent engagement parts 13 press-fit in the rear 2*b* of housing 2. As seen clearly in FIG. 2, one of the engagement parts 13 is mounted at each opposite side or extreme end of the rear 2*b* of the housing. Referring to FIGS. 9–11 in conjunction with FIGS. 1–8, each engagement part 13 is fabricated of metal material and includes a base plate 16 and a forwardly protruding press-fitting projection 17 integrally connected to a front end 16*a* of base plate 16. Each engagement part also includes a horizontal strip 18 integrally connected to the top edge of the base plate and generally at a right-angle thereto. In essence, the base plate of the engagement part depends from horizontal strip 18. A solder tail 19 is integrally connected to the bottom of base plate 16. Each engagement part includes one of the pivots 14 described above. When assembled to housing 2, horizontal strip 18 of each engagement part 13 is flush with a top surface 2*d* of the housing; the engagement part extends down along a respective side 2*c* of the housing; pivot 14 projects outwardly of the respective side of the housing; and solder tail 19 extends below the housing for soldering to appropriate solder pads on the printed circuit board.

Figure 1:
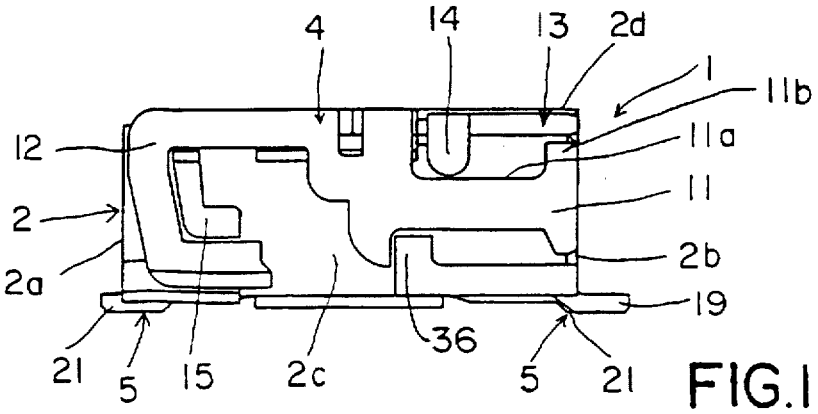
FIG. 1 is a side elevational view of a flat cable connector according to the present invention.

It can be seen in FIG. 1 that solder tails 19 are in alignment with solder tails 21 of terminals 5.

Figure 12:
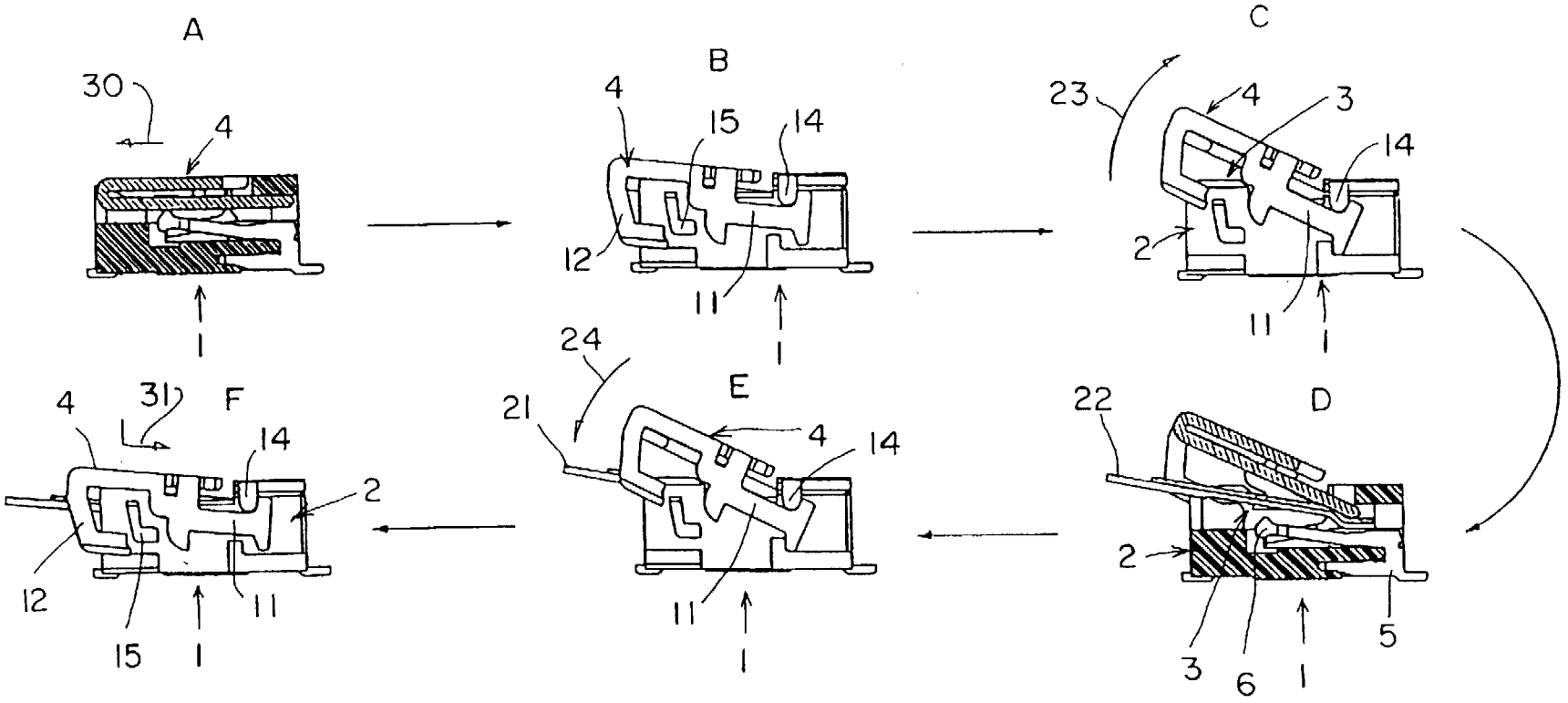
FIG. 12 shows a sequence of views illustrating how a flat cable is connected to the connector.
Figure 13:
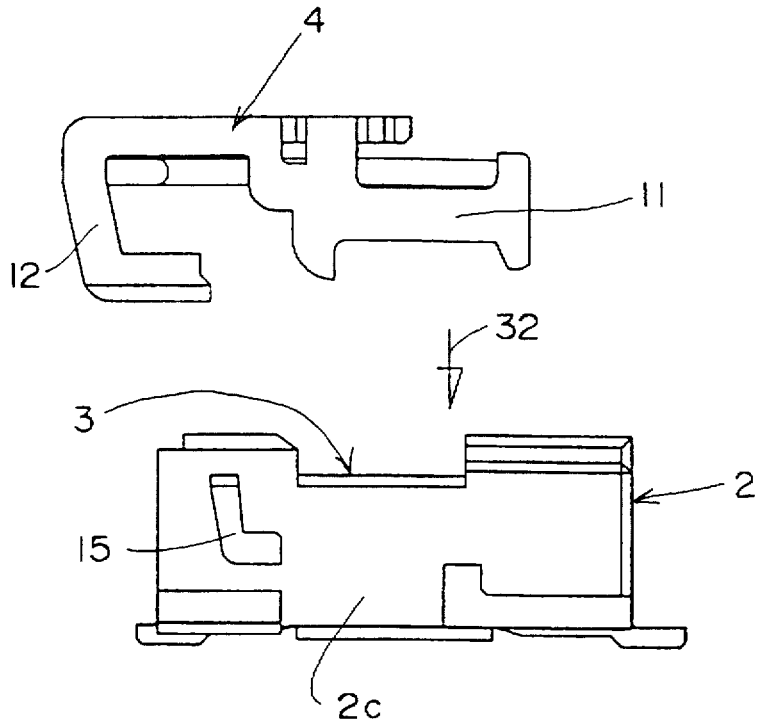
FIG. 13 is an exploded side elevational view of the actuator about to be mounted onto the housing.

Referring to FIG. 12, the manner in which a flat cable 22 is inserted into connector 1 now will be described. First, actuator 4 is caused to slide forward in the direction of arrow 30 (see "A") with respect to housing 2 until L-shaped front extensions 12 of the actuator clear L-shaped locking projections 15 (see "B"). The actuator then is rotated in the direction of arrow 23 (see "C") to open opening 3 of housing 2. The stripped end of flat cable 22 then is inserted into opening 3 of the housing (see "D"). The actuator then is rotated or pivoted back downwardly in the direction of arrow 24 (see "E") to close opening 3 of the housing. The actuator then is caused to slide rearwardly in the direction of arrow 31 (see "F"). Finally, L-shaped front extensions 12 of pivot arms 11 are engaged with L-shaped locking projections 15 on the opposite sides 2*c* of housing 2, as seen in FIG. 1, to lock the actuator to the housing and prevent the actuator from pivoting away from its closed position. In this position, the exposed conductors of flat cable 22 are pressed into contact with flexible contacts 6 of terminals 5 to establish a required electrical connection between the flat cable and an associated electronic device, such as the circuit traces on a printed circuit board (not shown).

As can be understood from the above, actuator 4 rotates about pivots 14 of engagement parts 13, permitting edges 11*a* of the pivot arms to slide on the pivots. With these rubbing components 11 and 14 made of metal material, little wear will be caused, thus assuring that the pivotable actuator can be repeatedly used for an extended period.

As stated in the "Background", above, assembling actuator 4 to housing 2 is accomplished in the present invention without spreading pivot arms 11 which, otherwise, could cause deformation of the pivot arms. In other words, no deformation of the pivot arms results with the invention as is experienced in many prior art flat cable connectors. This problem is solved by using the independent engagement parts 13. FIGS. 13–17 show the manner in which actuator 4 and engagement parts 13 are assembled to housing 2.

Figure 14:
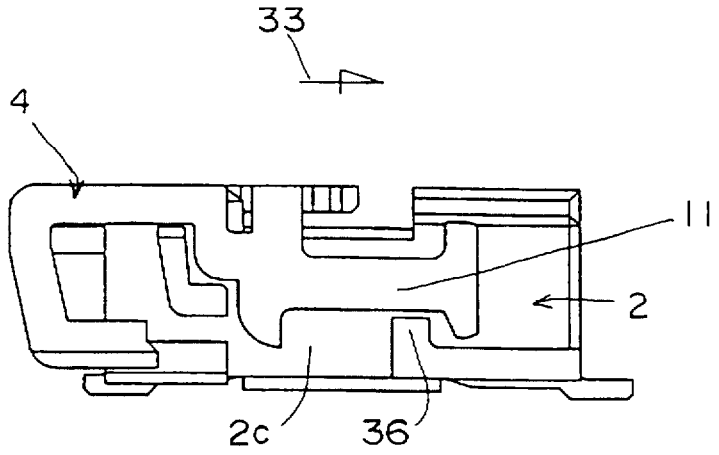
FIG. 14 is a view similar to that of FIG. 13, with the actuator mounted on the housing.

More particularly, actuator 4 is assembled to housing 2 in the direction of arrow 32 (FIG. 13) until the actuator is mounted on the housing as shown in FIG. 14. Pivot arms 11 of the actuator simply slide downwardly along opposite sides 2*c* of housing 2, without in any way spreading the pivot arms apart which might cause deformation. The actuator then is caused to slide rearwardly in the direction of arrow 33 (FIG. 14) until the actuator is in the position shown in FIG. 15.

Figure 2:
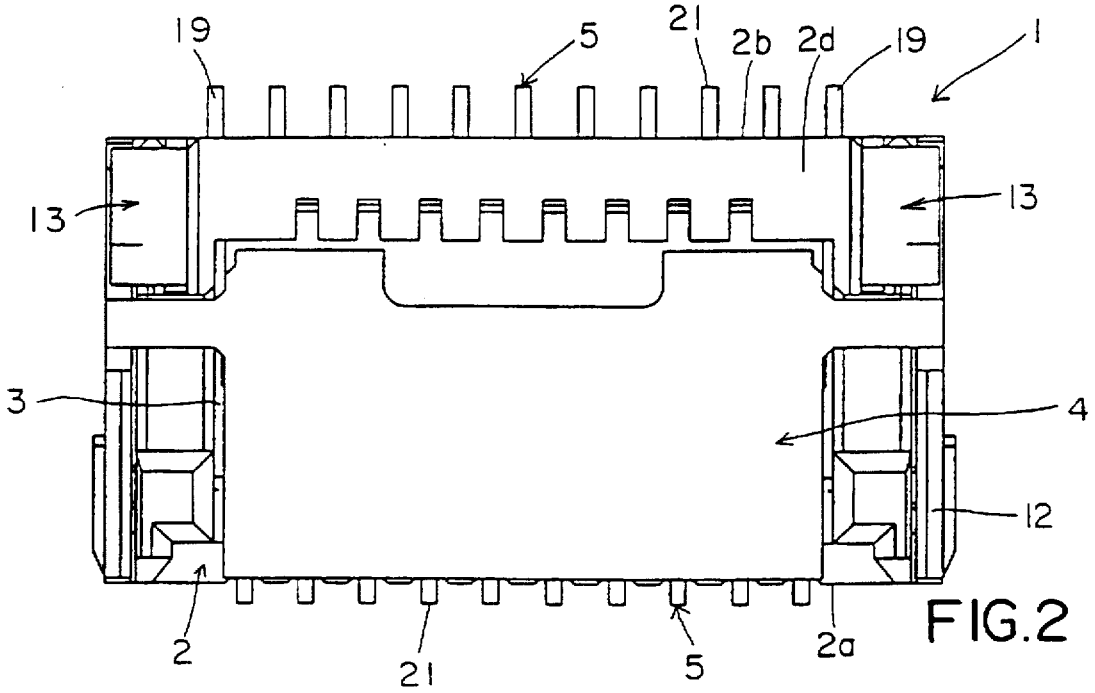
FIG. 2 is a top plan view of the connector.
Figure 3:
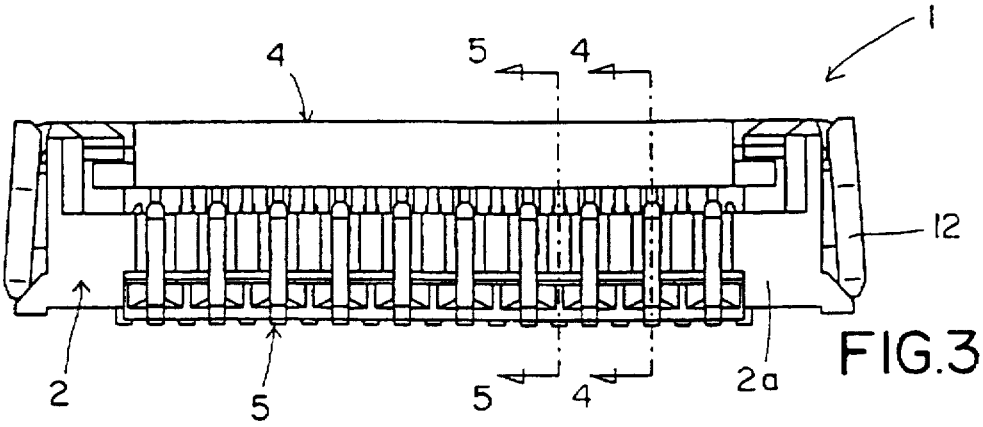
FIG. 3 is a front elevational view of the connector.
Figure 15:
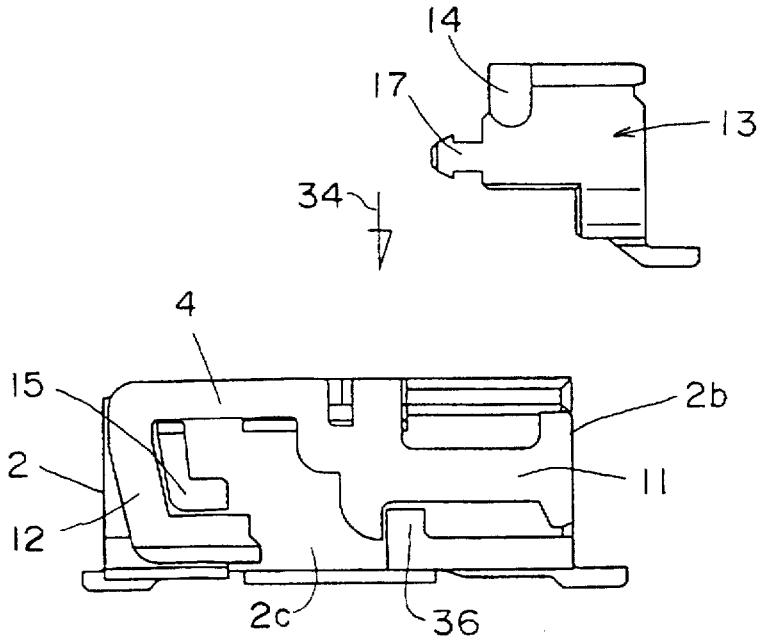
FIG. 15 is a view similar to that of FIG. 14, with the actuator moved rearwardly and the engagement part about to be mounted on the housing.
Figure 16:
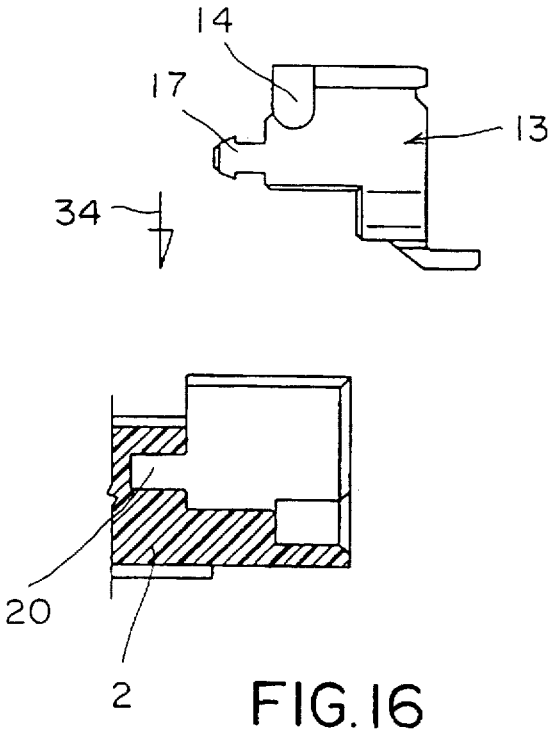
FIG. 16 is a fragmented section through the housing, in conjunction with the engagement part, to show the mounting means between the housing and the engagement part.
Figure 17:
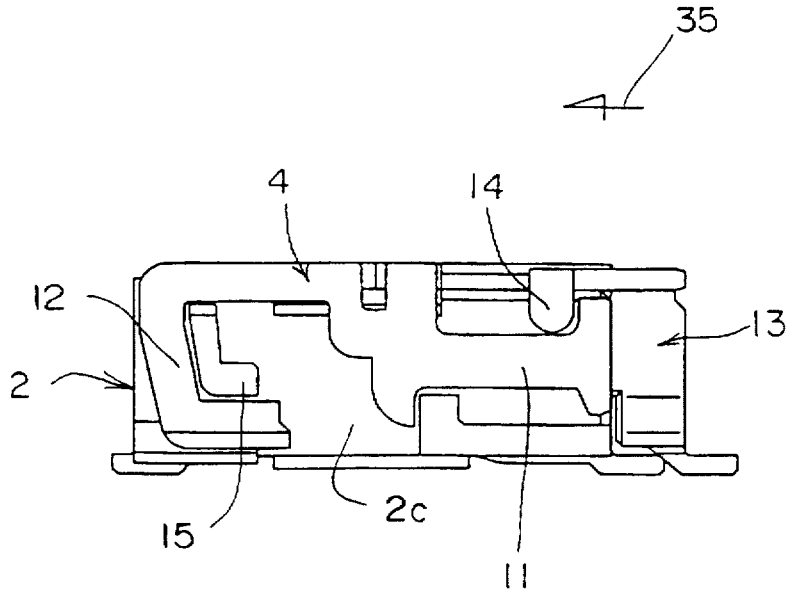
FIG. 17 is a side elevational view of the completely assembled connector, including the housing, the actuator and the engagement part.

Thereafter, engagement parts 13 are mounted to the housing by simply moving the engagement parts downwardly onto the housing in the direction of arrows 34 (FIGS. 15 and 16). The engagement parts are moved downwardly until press-fitting projections 17 are in alignment with press-fitting holes 20 (FIG. 16) in housing 2. This position of the engagement parts is shown in FIG. 17. The engagement parts then are pushed forwardly in the direction of arrow 35 (FIG. 17) to force press-fit projections 17 into holes 20, whereupon the engagement parts are in the fully assembled position as shown in FIG. 2. In this position, pivot arms 11 are sandwiched between pivots 14 of the engagement parts and upstanding mounting bosses 36 at sides 2*c* of the housing.

In summation, it can be seen that by using the independent engagement parts 13, actuator 4 can be mounted or assembled to housing 2 without in any way spreading and deforming the pivot arms of the actuator. In addition, by fabricating the independent engagement parts of metal material, metal pivots 14 do not wear as is prevalent with the plastic housings of the prior art, particularly if the actuator also is fabricated of metal material.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for a flat cable, comprising:

a dielectric housing mounting a plurality of conductive terminals, the housing having a front end adapted for receiving the flat cable in engagement with the terminals, a rear end and opposite sides;

an actuator pivotally mounted on the housing for pivotal movement between a first position allowing insertion of the flat cable into engagement with the terminals and a second position biasing the cable against the terminals;

an independent engagement part mounted on the housing and including pivot means about which the actuator is pivotable between said positions; and complementary interengaging mounting means between the housing and the engagement part for mounting the engagement part at the rear of the housing.

2. The electrical connector of claim 1 wherein said engagement part is fabricated of metal material.

3. The electrical connector of claim 2 wherein said actuator is fabricated of metal material.

4. The electrical connector of claim 1 wherein said actuator includes a pair of side pivot arms positionable outside the opposite sides of the housing without significantly spreading the pivot arms apart.

5. The electrical connector of claim 1 wherein said housing is adapted for mounting on a printed circuit board, said engagement part is fabricated of metal material and includes a solder tail for soldering to an appropriate pad on the printed circuit board.

6. An electrical connector for a flat cable, comprising:

a dielectric housing mounting a plurality of conductive terminals, the housing having a front end adapted for receiving the flat cable in engagement with the terminals, a rear end and opposite sides;

an actuator of metal material pivotally mounted on the housing for pivotal movement between a first position allowing insertion of the flat cable into engagement with the terminals and a second position biasing the cable against the terminals, the actuator including a pair of side pivot arms positionable outside the opposite sides of the housing without significantly spreading the pivot arms apart;

an independent engagement part of metal material mounted on the housing and including pivot means about which the actuator is pivotable between said positions; and complementary interengaging mounting means between the housing and the engagement part for mounting the engagement part at the rear of the housing.

7. The electrical connector of claim 6 wherein said housing is adapted for mounting on a printed circuit board, and said engagement part includes a solder tail for soldering to an appropriate pad on the printed circuit board.

8. The electrical connector of claim 6, including a pair of said engagement parts at each opposite side of the housing, with each engagement part including one of said pivot means for engaging a respective one of the pivot arms of the actuator.

9. The electrical connector of claim 8 wherein said pivot arms are sandwiched between the pivot means and a pair of abutment shoulders of the housing at the opposite sides thereof.

* * * * *